US005404623A

United States Patent [19]

Smiedt

[11] Patent Number: 5,404,623

[45] Date of Patent: Apr. 11, 1995

[54] ADJUSTABLE FASTENERS FOR WAIST BANDS

[75] Inventor: Leslie Smiedt, Cape Province, South Africa

[73] Assignee: B.A.L. International (Proprietary) Limited, Cape Town, South Africa

[21] Appl. No.: 80,077

[22] Filed: Jun. 18, 1993

[30] Foreign Application Priority Data

Jun. 18, 1992 [ZA] South Africa ..... 92/4452

[51] Int. Cl.[6] ..... A41F 1/00; A44B 11/00

[52] U.S. Cl. ..... 24/614; 24/194; 24/686

[58] Field of Search ..... 24/194, 171, 614, 617, 24/615, 616, 181, 323, 322, 519, 686, 309, 314, 317

[56] References Cited

U.S. PATENT DOCUMENTS

| | | | |
|---|---|---|---|
| 223,939 | 1/1880 | Miller | 24/194 |
| 350,846 | 10/1886 | Sandeers | 24/686 |
| 410,260 | 9/1889 | Bagley | 24/323 |
| 1,055,008 | 3/1913 | Wright | 24/194 |
| 1,205,247 | 11/1916 | Munroe | 24/614 |
| 1,303,704 | 5/1919 | Stone et al. | 24/171 |
| 1,507,216 | 9/1924 | Stokton . | |
| 1,957,257 | 5/1934 | Freysinger . | |
| 2,281,999 | 5/1940 | Rieback . | |
| 2,355,331 | 8/1944 | Roberts et al. | 24/194 |
| 3,513,510 | 5/1970 | Copes | 24/323 |
| 3,670,931 | 6/1972 | Hosey . | |
| 4,062,063 | 12/1977 | Bloom et al. | 24/686 |

FOREIGN PATENT DOCUMENTS

| | | | |
|---|---|---|---|
| 435741 | 3/1911 | France . | |
| 1014343 | 8/1952 | France . | |
| 0268652 | 12/1913 | Germany | 24/686 |
| 321203 | 5/1919 | Germany . | |
| 371535 | 3/1923 | Germany . | |
| 2150628 | 7/1985 | United Kingdom . | |

*Primary Examiner*—Victor N. Sakran
*Attorney, Agent, or Firm*—Ladas & Parry

[57] ABSTRACT

An adjustable waist hand fastener disclosed comprises two components, namely, a button and a plate which can be fixed to one end portion of a waist band. The plate has a slot running along it. The button passes through the slot and can be displaced along the slot. The structure is such that the button can be fixed in any one of a number of positions along the slot. The button can be positioned in two or more predetermined positions or be infinitely adjustable. The button can be a one part construction or comprise two parts. When a two part button is used, the stem of one part is pushed through the slot before the two parts are connected together. When a one part button construction is used, the button must be capable of passing through the slot when in an appropriate position of orientation. The other end portion of the waist band includes a buttonhole which the button fits. The fastener enables the length of the waist band readily to be increased or decreased by displacing the button along the slot.

5 Claims, 3 Drawing Sheets

ADJUSTABLE FASTENERS FOR WAIST BANDS

FIELD OF THE INVENTION

This invention relates to adjustable fasteners for waist bands.

BACKGROUND TO THE INVENTION

It is sometimes convenient to be able to adjust the length of the waistband of a garment. For example, letting it out after a heavy meal can reduce the tension on the band and hence make it less uncomfortable. If one portion of the waist band is provided with a single button and the other portion with a number of button holes, then a degree of adjustment can be obtained. However, the unused button holes are always visible, and are unsightly. Furthermore, in the position of adjustment when the waist band is at its smallest, the unused button holes are in a part of the waist band which flaps freely unless several buttons are provided to hold the flap in place. The provision of a number of button holes and a number of buttons is aesthetically unpleasing and complicate fastening and unfastening of the waist band.

OBJECT OF THE INVENTION

The object of the invention is to provide an adjustable fastener which permits a waist band to take-up two or more different sizes without the necessity of providing more than one button or more than one button hole.

BRIEF SUMMARY OF THE INVENTION

According to one aspect of the present invention there is provided an adjustable fastener for the waist band of a garment, the fastener comprising a plate, a slot in the plate, a button including a stem and a head, the stem passing through said slot and being movable along the slot, and means for locking the button with respect to the plate in the position in the slot to which it has been moved.

In one form said stem comprises a first part fast with said head and a second part connected to said first part by threading, the second part including two flats which fit between the bounding faces of said slot and prevent said second part rotating with respect to said plate, said first and second parts, when screwed together, clamping said plate between them so that the button is fixed with respect to said plate.

In other form there are two rows of teeth on one face of the plate, the rows of teeth being one on each side of said slot, said button including a second head at the end of the stem remote from the first mentioned head, said second head including at least one tooth configured so that it fits in the gaps between the teeth of said rows.

According to a further aspect of the present invention there is provided an adjustable fastener for the waist band of a garment, the fastener comprising a plate which can be fixed to the waist band, there being rows of teeth along two opposed edges of said plate, a bridging piece comprising a central section which spans across said plate between said edges, there being a gap between said bridging piece and said plate, and two legs which protrude from opposite ends of said central section and inter-engage between teeth of said rows thereby releasably to secure said bridging piece in its position of adjustment with respect to said plate, said bridging piece being flexible in such manner that distortion of said bridging piece splays said legs apart out of engagement with said teeth so that the position of said bridging piece with respect to the plate can be adjusted.

BRIEF SUMMARY OF THE DRAWINGS

For a better understanding of the present invention, and to show how the same may be carried into effect, reference will now be made, by way of example, to the accompanying drawings in which.

DETAILED DESCRIPTION OF THE DRAWINGS

Figure 1:
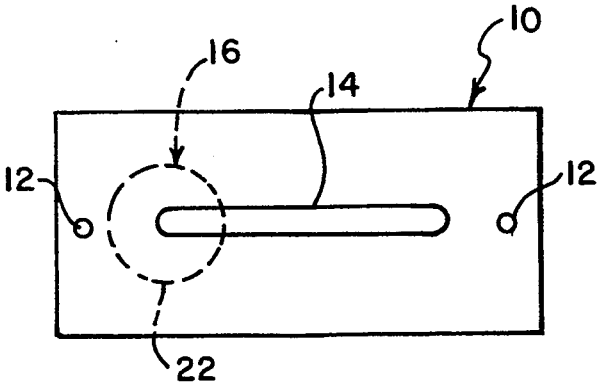
FIG. 1 is a top plan view of a plate forming one component of an adjustable fastener, the other component of the fastener being shown in outline.

Referring firstly to FIG. 1, reference numeral 10 designates a plate which has two holes 12 and an elongate slot 14 therein. The holes 12 receive rivets (not shown) which enable the plate 10 to be secured to one of the ends of the waist band of a garment.

Figure 3:
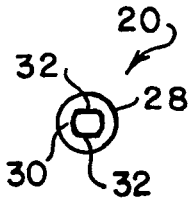
FIG. 3 is an end view of one part of the button of FIG. 2.
Figure 2:
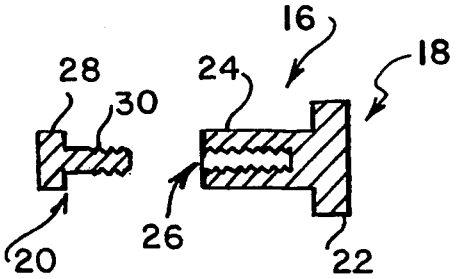
FIG. 2 is a section illustrating a two-part button which forms the other component of the fastener.

FIGS. 2 and 3 illustrate a button generally designated 16 which comprises two parts designated 18 and The part 18 has a head 22 which is circular in plan view (see FIG. 1) and a stem 24 which is co-axial with the head 22. The stem 22 has a blind, tapped socket 26 therein. The part 20 includes a head 28 and a stem 30. The stem is threaded over part of its length and the threading in the socket 26 and on the stem 30 are compatible. The stem 28 is formed with two flats designated 32 (see particularly FIG. 3).

Before the plate 10 is riveted to the waist band, the stem 30 is pushed through the slot 14 and screwed into the socket 26. The flats 32 are in the slot 14 and the distance across the flats 32 is just less than the width of the slot. The flats 32 prevent the part 20 rotating with respect to the plate 10. When the plate 10 is riveted to the waist band, the head 28 is trapped between the material of the garment and the plate 10. The plate 10 is clamped between the head 28 and the end of the stem 24 when the part 18 is tightened onto the non-rotatable part 20. The other end of the waist band had a normal button hole in it and this receives the head 22 to fasten the waist band.

To enable the effective length of the waist band to be adjusted, the part 18 is turned so that it unscrews slightly with respect to the head 28 thus unclamping the plate 10. The button 16 can then be slid along the slot 14. Re-tightening the part 18 onto the part 20 clamps the plate 10 again and locks the button in position. The effective circumferential length of the waist band from the button hole in one waist band end part to the button 16 on the other waist band end part can thus be varied.

Referring now to FIGS. 4 to 7, these Figures illustrate a two part button 34. The first button part includes a circular head 36 and, a stem 38 co-axial with the head 36, and the second button part comprises a square head 40 and a stem 42 integral with the head 40. The surface of the square head 40 which faces the head 36 is formed with one or more elongate V-shaped teeth 44. The stem 42 is threaded and the stem 38 includes a tapped socket (not shown) into which the stem 42 can be screwed.

The plate 46 has two rivet holes 48 to enable it to be secured to the waist band and a slot 50 with a row of teeth 52 on each side thereof. The teeth 52 are in a recess in what becomes the hidden side of the plate.

Before the plate 46 is secured to the garment's waist band, the stem 42 is pushed through the slot 50, the stem 42 then being screwed into the socket of the stem 38. The head 40 is trapped between the fabric F of the garment and the plate 46 (see FIGS. 6 and 7) when the plate 46 is secured to the garment. The fabric F holds the head 40 against the teeth 52 so that the button 34 cannot be moved along the slot 50. To adjust the position of the button 34 with respect to the plate 46, the head 36 is pushed towards the plate 46 (see arrow A in FIG. 7) thereby distorting the fabric F and moving the teeth 44 of the head 40 away from the teeth 52. The button 34 can now be slid along the slot 50 and, when it is released, the teeth 42 re-engaged between other teeth 52 thereby locking the button 34 in its new position of adjustment.

The other part of the waist band, when the embodiment of FIGS. 4 to 7 is used, includes a button hole which receives the head 36.

The head 40 can be replaced by a cross bar with a single tooth. In this form the button can be in one piece. To mount it on the plate 46, the cross bar is aligned with the slit 50 and pushed through and thereafter the button is turned through ninety degrees.

Figure 9:
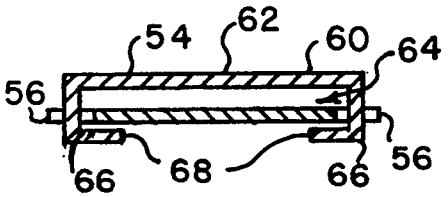
FIG. 9 is a section on the line IX—IX of FIG. 8.
Figure 8:
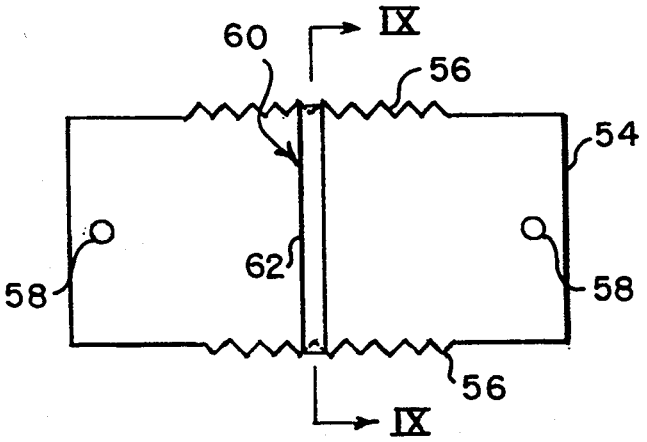
FIG. 8 is a plan view of a further adjustable fastener.
Figure 5:
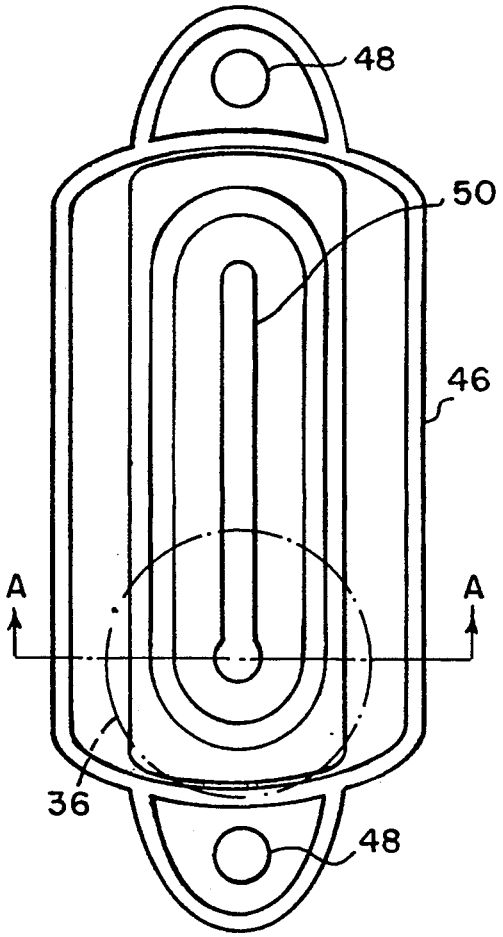
FIG. 5 is a plan view of the other side of the plate of FIG. 4 and shows the button in outline.
Figure 4:
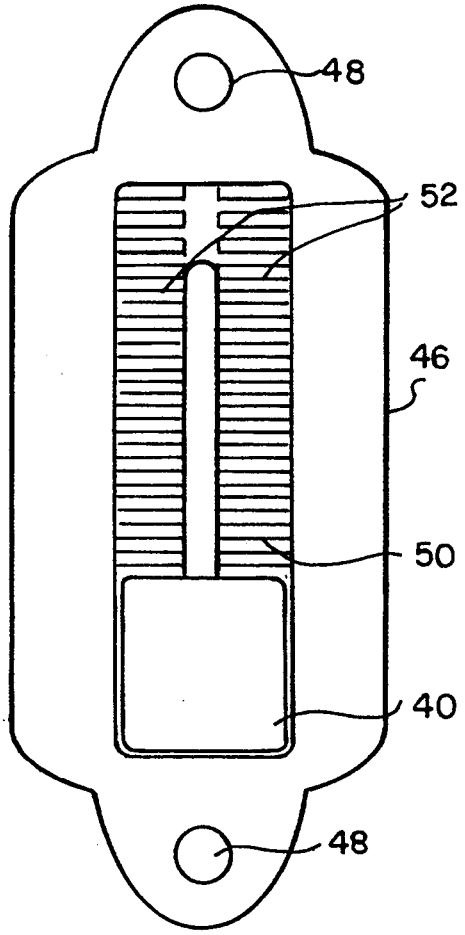
FIG. 4 is a plan view of one side of a plate, and also shows a button.
Figure 6:
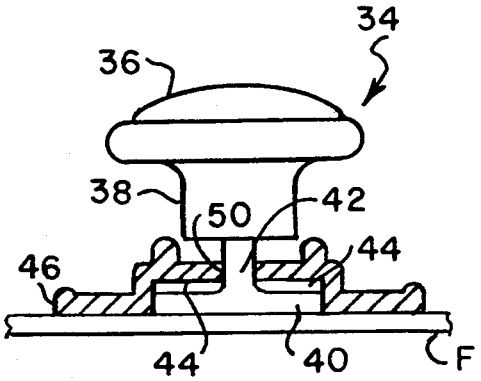
FIGS. 6 and 7 are sections on line A—A of FIG. 5 and show the fastener in two different operative conditions.
Figure 7:
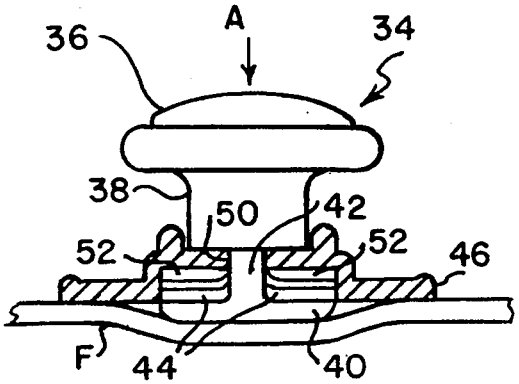

Turning now to FIGS. 8 and 9, the plate 54 illustrated has teeth 56 along two opposed edges thereof. It further has two holes 58 by means of which it can be riveted to the garment's waist band.

A bridging piece designated 60 comprises a central section 62 which spans across the plate 54 between the two toothed edges thereof, there being a gap 64 between the central section 62 and the plate 54. At each end of the central section 62 there is a leg 66 which is at right angles to the central section 62. The legs 66 engage between adjacent teeth 56. The legs 66 are extended inwardly by hooks 68 which engage under the plate 54 and prevent the bridging piece 60 being lifted away from the plate. This embodiment is used in conjunction with a metal hook (not shown) on the other part of the waist band, the metal hook being inserted into the gap designated 64.

The bridging piece 60 is adjusted along the plate 54 by pressing the central section 62 towards the plate 54 so that is bows. This splays the legs 66 apart to a position in which they are clear of the teeth 56. The piece 60 can then be moved along the plate 54.

Figure 10:
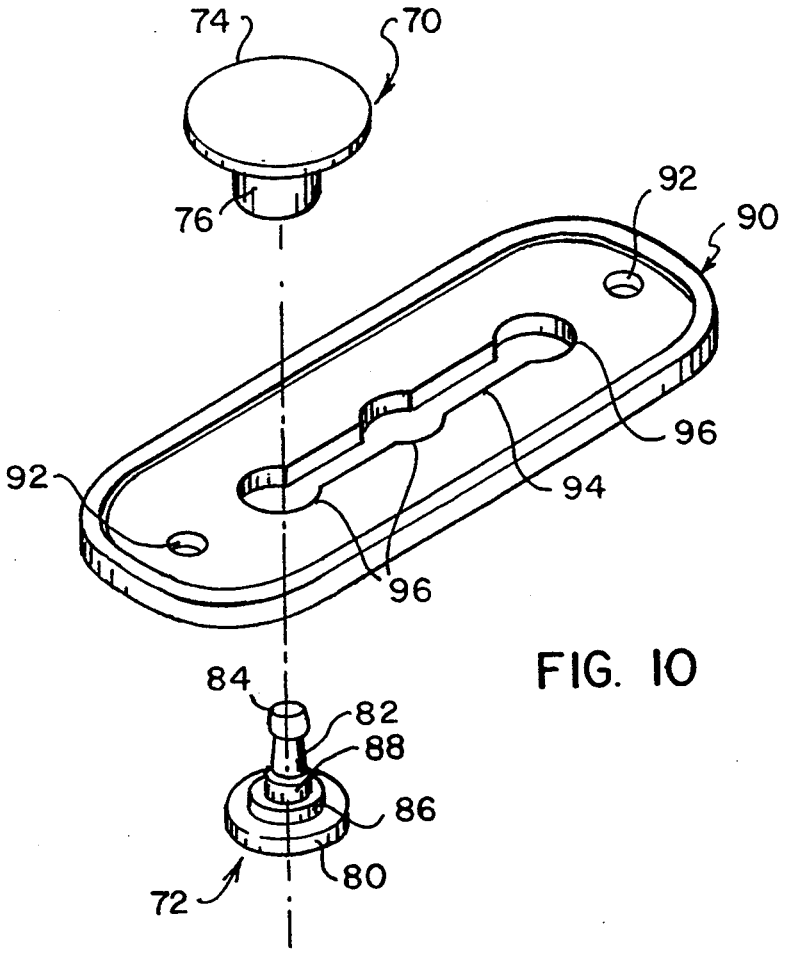
FIG. 10 is a pictorial view of another form of plate and button.
Figure 11:
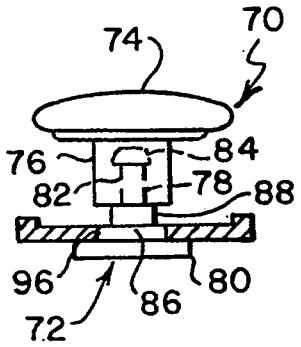
FIG. 11 is a section showing the button and plate of FIG. 10.

Referring now to FIGS. 10 and 11, the button illustrated has two parts designated 70 and 72. The part 70 comprises a head 74 and a stem 76. The stem 76 has a socket 78 therein (see FIG. 11). The part 72 has a head 80 and a stem 82, the stem having an enlargement 84 at the free end thereof. Between the head 80 and the stem 82 the part 72 is stepped down twice to provide two discs 86 and 88.

The plate shown in FIGS. 10 and 11 is designated 90 and has two holes 92 which enable it to be secured to a waist band. The plate 90 has a slot 94 therein which slot includes three enlarged portions 96. The diameter of each portion 96 is slightly more than the diameter of the disc 86. The width of the remainder of the slot 94 is slightly more than the diameter of the disc 88. Therefore, the heads 70,72 are too large to pass through the slot 94,96.

Before the plate 90 is secured to the waistband, the stem 82 is pushed through the slot 94 and then inserted into the socket 78. The enlargement 84 of the stem 76 is a snap-fit in the socket 78. The button is positioned so that the larger disc 86 is in one of the enlarged portions 96 of the slot 94. When the plate 90 is secured to the waistband, the fabric of the waistband holds the larger disc 86 in the enlarged portion 96. When it is desired to adjust the fastener, the head 74 is pushed down thereby distorting the fabric and shifting the larger disc 86 out of the enlarged portion 96. The smaller disc 88 is now in the slot 94 and the button 70 can thus be slid along the slot to another enlarged portion 96. When the button is released, the fabric forces the button back to the position in which the larger disc 86 is in another enlargement 96 of the slot.

Figure 12:
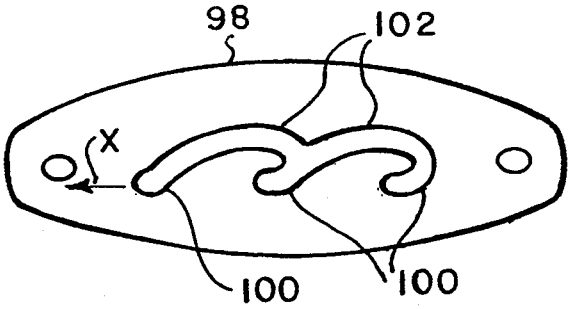
FIG. 12 is a plan view of another form of plate.

In FIG. 12, the plate is designated 98 and has a series of curved sub-slots 100 which extend away from a main slot 102. A two part button of, for example, the form shown in FIGS. 10 and 11 but without the discs 86 and 88 is used with this plate. The heads 70,72 of the button are also too large to pass through the slot 100,102. In use the button is pulled, by the part of the waist band that has the button hole in it, in the direction indicated by arrow X. To move the button, the tension on the waist band is reduced by pushing the two end portions of the waistband together, shifting the button along the sub-slot 100 that it is in and into the main slot 102, along the main slot, and back into another sub-slot.

The structure of FIG. 12 provides three positions of adjustment. It will be understood that this number can be decreased to two, or increased to four or more, by altering the number of sub-slots 100.

In a further form, which is similar to that described with reference to FIG. 12, the button that adjusts along the plate 98 includes an arm which protrudes from the button stem and has a hook at the free end thereof. The arm is free to pivot with respect to the button about the axis of the button stem. The plate is fixed to one end part of the waist band and a button to the other. The hook engages with this button to hold the waist band closed. The button which passes through the plate can be moved along the slot to provide the requisite adjustment.

I claim:

1. An adjustable fastener for the waist band of a garment, the fastener comprising a plate, a slot in the plate, a button including a stem and a head, the stem passing through said slot and being movable along the slot, and means for locking the button with respect to the plate in the position in the slot to which it has been moved, such means comprising two rows of teeth on one face of the plate, the rows of teeth being one on each side of said slot, said button including a second head at the end of the stem remote from the first mentioned head, said second head including at least one tooth configured so that it fits in the gaps between the teeth of said rows.

2. An adjustable fastener according to claim 1, wherein said second head is in the form of a cross bar having a single tooth, said cross bar being capable of passing through said slot when aligned therewith.

3. An adjustable fastener according to claim 1, wherein said second head comprises a series of parallel teeth, and said button comprises two parts, each part including one of the heads and part of said stem.

4. An adjustable fastener for the waist band of a garment, the fastener comprising a plate which can be fixed to the waist band, there being rows of teeth along two opposed edges of said plate, a bridging piece comprising a central section which spans across said plate between said edges, there being a gap between said bridging piece and said plate, and two legs which protrude from opposite ends of said central section and inter-engage between teeth of said rows thereby releasably to secure said bridging piece in its position of adjustment with respect to said plate, said bridging piece being flexible in such manner that distortion of said bridging piece splays said legs apart out of engagement with said teeth so that the position of said bridging piece with respect to the plate can be adjusted.

5. An adjustable fastener for the waist band of a garment, the fastener comprising a plate, a slot in the plate, the slot comprising a main slot which extends along the plate and a series of sub-slots which extend transversely of the main slot, each sub-slot having a portion at the end thereof which is remote from said main slot and which portion is parallel to said main slot, a button including a stem and a head at each end of the stem, the stem passing through said slot, said heads being too large to pass through said slot and the button being movable along said main slot and into a selected one of said sub-slots for waist band adjustment purposes.

* * * * *